United States Patent [19]

Kubis et al.

[11] 4,441,866

[45] Apr. 10, 1984

[54] OIL PUMP ARRANGEMENT

[75] Inventors: Heribert Kubis; Karl Schott, both of Nuremberg, Fed. Rep. of Germany

[73] Assignee: M.A.N. Maschinenfabrik Augsburg-Nürnberg Aktiengesellschaft, Nuremberg, Fed. Rep. of Germany

[21] Appl. No.: 309,412

[22] Filed: Oct. 7, 1981

Related U.S. Application Data

[63] Continuation of Ser. No. 66,627, Aug. 15, 1979, Pat. No. 4,334,836.

[51] Int. Cl.[3] ..... F04B 17/00

[52] U.S. Cl. ..... 417/364

[58] Field of Search ..... 417/364; 123/198 C, 123/195 A; 418/206

[56] References Cited

U.S. PATENT DOCUMENTS

| | | | |
|---|---|---|---|
| 3,208,393 | 9/1965 | Kosch | 418/206 |
| 3,384,063 | 5/1968 | Moultor et al. | 417/364 |
| 3,472,170 | 10/1969 | Eckerle | 418/206 |
| 3,601,515 | 8/1971 | Pelizzoni | 418/206 |
| 4,198,935 | 4/1980 | Seibt et al. | 123/198 C |

*Primary Examiner*—William L. Freeh
*Assistant Examiner*—Paul F. Neils
*Attorney, Agent, or Firm*—Becker & Becker, Inc.

[57] ABSTRACT

An oil pump arrangement for the pressure oil supply for internal combustion engines, especially a gear oil pump, which includes impeller gears housed in a pump housing. The gears are driven by the internal combustion engine and the pump housing is connected with a suction pipe and a pressure pipe. The pump housing is arranged in an unmachined recess provided at the side of the timing gears in the crankcase. The pump housing is open on the side of the driving means for the impeller gears and is flanged to the timing gear case of the internal combustion engine. The timing gear case forms the closure of the pump housing and the recess, and at least the driving means for the impeller gears is supported in the timing gear case.

1 Claim, 3 Drawing Figures

OIL PUMP ARRANGEMENT

This is a continuation application of Ser. No. 066,627—Kubis et al filed Aug. 15, 1979, now U.S. Pat. No. 4,334,836—Kubis et al issued June 15, 1982.

This invention relates to the arrangement of an oil pump for the pressure oil supply for internal combustion engines, especially a gear oil pump, which comprises impeller gears housed in a pump housing, the gears being driven by the internal combustion engine. The pump housing is connected with a suction pipe and a pressure pipe.

The pressure oil supply of internal combustion engines mainly relies on gear oil pumps with two similar hobbed and sintered gears which serve as impellers. Only rarely are gear oil pumps used with three gears or internal gear or Eaton pumps. The invention is therefore mainly directed to pumps of the former type, but can also be applied to other types.

Gear oil pumps may be driven by right-angle-gearing from the camshaft. In order to obtain a long service life with such a drive, is is important to accurately maintain the center distance of the right-angle gears. Furthermore, the accuracy of geometry of the right-angle gears is required to meet high standards. Since the right-angle gearing is capable of transmitting only relatively small powers, it is suitable only for certain engines but hardly for Diesel engines. Moreover, this type of drive involves a very long and expensive drive shaft from the camshaft, and a complex pump housing.

It is also general practice to obtain the drive for gear oil pumps from the crankshaft. There are, in the main, two possibilities. One is to provide a direct drive, where the oil pump is accommodated directly in the drive-and main bearing cap to obtain the necessary small center distance for the desired high speeds. This arrangement has the drawback that the oil pump is an integral part of the crankcase, since the main bearing cap has to be finish-machined together with the crankcase. In the event of damage to the oil pump, it would be necessary to replace the entire crankcase.

Alternatively, the drive of the oil pump can be taken from the crankshaft in a manner that the oil pump is arranged above and separate from the main bearing cap. Since this involves a great center distance between the crankshaft and the oil pump, an intermediate or idler gear is necessary. The drawback of this solution is that it involves extra cost for the idler gear and its bearings. The provision of a separate idler gear also frequently gives rise to noise problems, because it is difficult to maintain accurate center distances and shaft orientations for the gears.

Admittedly, in the latter arrangement it is possible to bridge the great center distance obtained by adopting an outsize drive gear for the oil pump. Such a wheel will be costly, however, and the speed of the oil pump will be reduced, so that in order to ensure an adequate delivery, the pump will have to be made large and heavy, which entails additional costs.

Finally, the large center distance may be bridged by a chain drive. This, in turn, involves a drawback in that the overall length of the engine is increased because, apart from the space needed for the timing gear train, a separate track is needed for the chain of the oil pump drive. Moreover, a chain drive is disadvantageous in that special measures have to be provided as a rule to compensate for expansion which inevitably occurs.

Furthermore, the chain drive calls for the maintenance of highly accurate center distances and imposes stringent requirements on the geometry of the drive gear.

All the solutions described have a common disadvantage in that the exposed oil pump has to be connected by means of a special delivery pipe to the crankcase. True, there are engines where a separate pressure pipe is not provided because this is incorporated in the pump housing, but this involves a cavity in the housing which makes the casting complex and expensive.

This is the starting point of the present invention, the object of which is to connect an oil pump of the aforementioned type with the internal combustion engine, and/or to arrange it on the engine, in such a manner that the drawbacks described above are avoided, i.e. that the oil pump is arranged in a space-saving manner without any great costs and in a favorable manner in respect to its drive.

This object and other objects and advantages of the present invention will appear more clearly from the following specification in connection with the accompanying drawings, in which.

Figure 1:
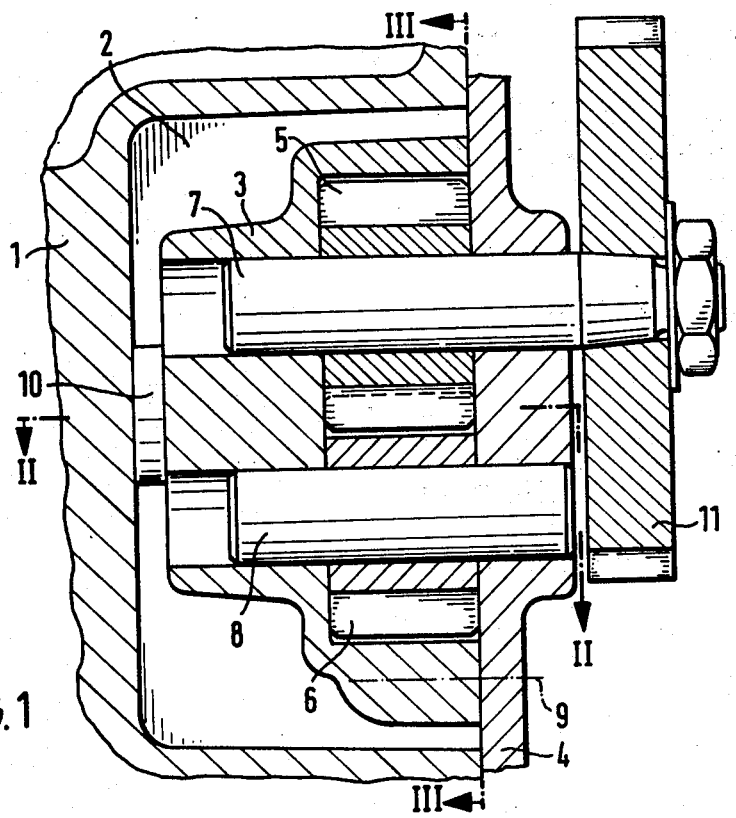
FIG. 1 is a longitudinal section through an oil pump consisting of two impeller gears and arranged according to the invention.

The oil pump arrangement of the present invention is characterized primarily by arranging the pump housing in an unmachined recess provided at the side of the timing gears in the crankcase or engine block, with the pump housing being open on the side of the driving means for the impeller gears and being flanged to the timing gear case of the internal combustion engine, with the timing gear case forming the closure of the pump housing and the recess, at least the driving means for the impeller gears being supported in the timing gear case.

The rough-cast unmachined recess in the crankcase first and foremost provides a space-saving low-cost arrangement of the oil pump. Since the pump housing is flanged to the timing gear case and is closed by the latter, there is no need for a pump housing cover. At the same time, there is the possibility of supporting the impeller gears of the oil pump, at least the driving means of the impeller gears, in the timing gear case, so that accurate center distances and shaft alignments can be maintained.

Since the recess in which the pump housing is arranged is also sealed off by the timing gear case, it is proposed as a further development of the invention to form this as a suction space of the oil pump, thus obtaining an additional advantage in that the pump housing is simplified. The recess can be readily connected, by a low-cost drilled hole or bore in the engine crankcase, with the suction pipe and, through an opening in the pump housing, the oil is admitted to the suction side of the impeller gears.

According to the present invention, the pressure side of the pump housing is connected to the pressure pipe in the crankcase by a connecting pipe which is sealed off from the recess. This affords the advantage that slight variations in the centers between the pump housing outlet and the pressure pipe can be compensated for by having the connecting pipe assume an oblique position, as well as the advantage of compensating for slight variations in the distance between the crankcase and the pump housing.

Where the drive means for the impeller gears consists of a drive gear connected with the latter, which is general practice, it is proposed as a further development of the invention that this drive gear mesh with an idler gear, which is supported on a pin, etc. also supported or fixed in the timing gear case and actually already exists for the drive of the fuel injection pump or the ignition distributor and the camshaft. As a result, there is no need for an additional costly idler gear and, with both gears supported in the timing gear case, the accurate maintenance of center distance and shaft alignments can be achieved relatively easily.

Finally, the invention also covers an arrangement where the drive gear for the oil pump meshes directly with the fuel injection pump drive gear mounted in the timing gear case or with the ignition distributor drive gear or with the camshaft drive gear, affording the same advantages as discussed above.

Referring now to the drawings in detail, FIG. 1 partially shows a crankcase 1 which is provided with a rough-cast unmachined recess 2 in which is accommodated an oil pump casing or housing 3, which is open at one end. Both the oil pump housing 3 and the recess 2 are tightly sealed by means of suitable interposed gaskets, which are not shown in the drawing, against the wall of a timing gear case 4 and towards the outside, the oil pump housing 3 being tightly flanged to the timing gear case 4 by means of schematically shown screws or bolts 9. Arranged in the oil pump housing 3 without any cavity being formed are two impeller wheels 5, 6 formed as gear wheels and meshing with each other, the shafts 7, 8 of which are rotatably supported at one end in the oil pump housing 3 and at the other end in the timing gear case 4, with the shaft 7 penetrating through the wall of the timing gear case and being firmly connected to a drive wheel 11 formed as a gear wheel. Furthermore, part of a connecting pipe 10 can be seen which will be referred to later.

Figure 2:
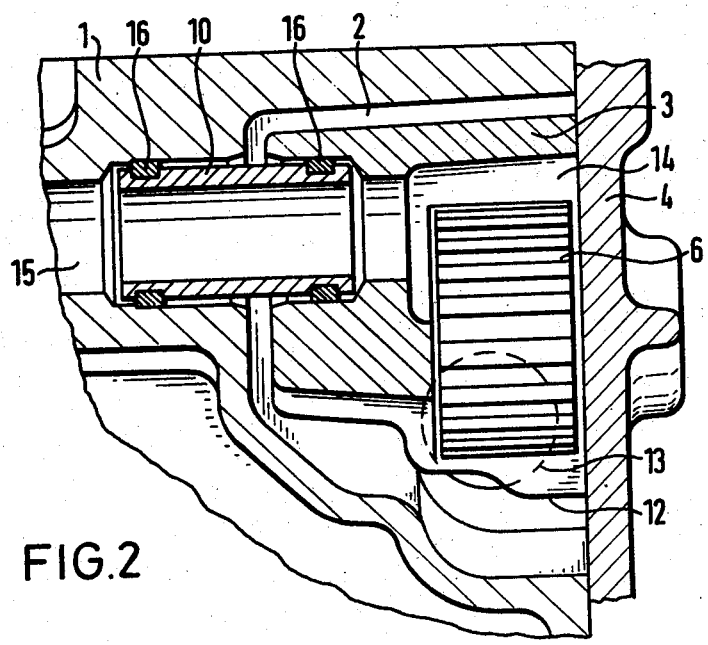
FIG. 2 is a section taken along the line II—III of FIG. 1.

It can be seen from FIG. 2 that the suction side of the pump housing 3 permanently communicates through an opening 12 with the recess 2. As a result, the recess 2 becomes the suction space for the oil pump, which is connected to the suction pipe by the drilled passage or bore 13, shown by a broken line, in the crankcase 1. The connecting pipe 10 forms the passage from the pressure side 14 of the pump housing 3 to the pressure line 15 in the crankcase 1. In order to seal the pressure side 14 against the suction space 2, the connecting pipe 10 is provided with gaskets 16 which, by virtue of an appropriate play, permit a slightly skewed position of the connecting pipe 10 in order to compensate for any center variations of the pressure side 14 relative to the pressure line 15.

This also makes it possible to compensate for slight variations in the distance between the crankcase 1 and the pump housing.

Figure 3:
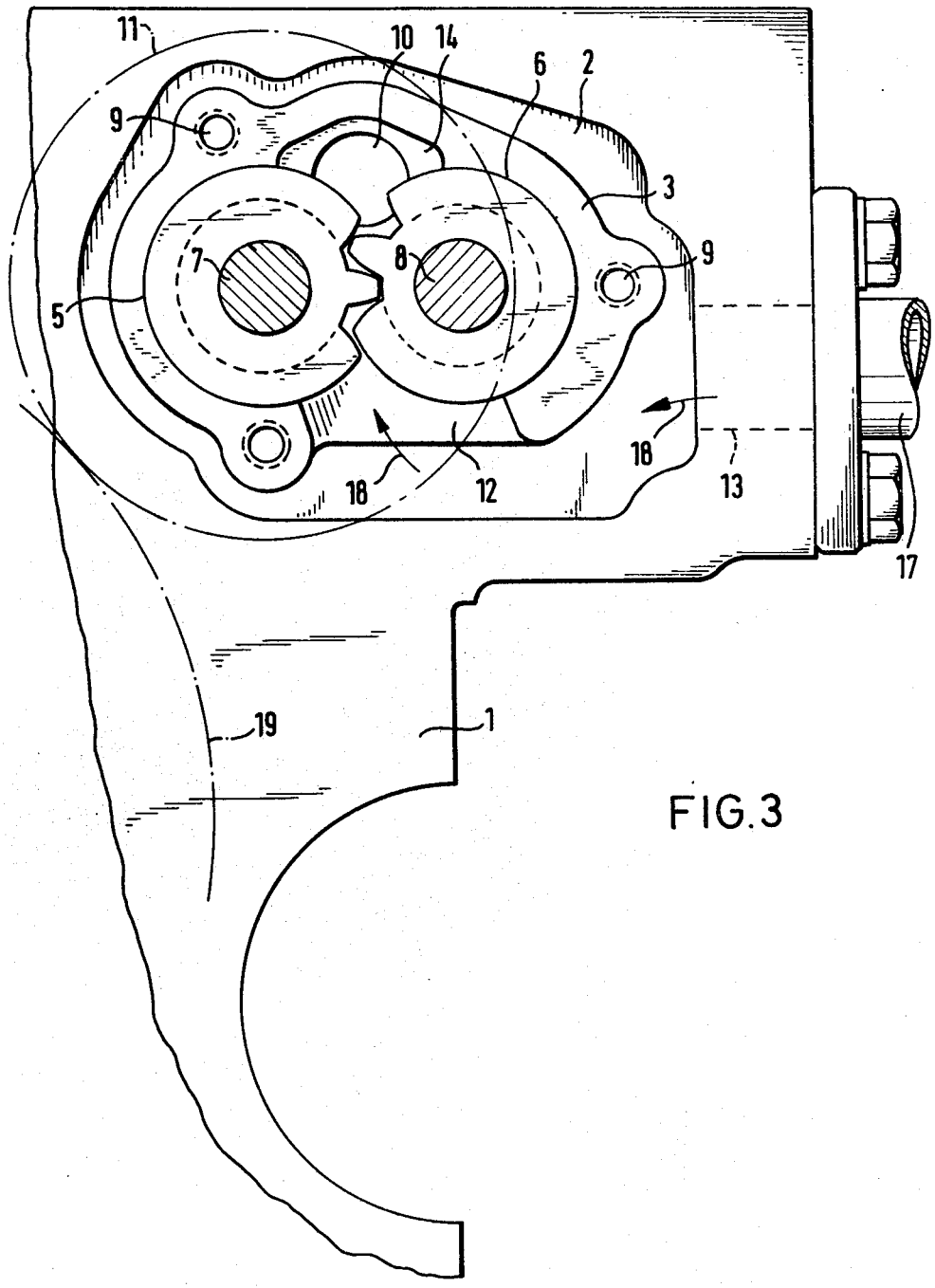
FIG. 3 is a section taken along the line III—III of FIG. 1.

FIG. 3 schematically shows a suction duct or pipe 17 through which the oil flows, as shown by the arrows 18, to the suction side of the oil pump. The drive gear 11 for the impeller gears 5, 6 is shown only by its pitch circle. It can be seen that it meshes with the idler gear 19, which is also shown only by its pitch circle. This idler gear 19 is also supported in the timing gear case 4 and serves, in a manner generally adopted but not shown, to drive the fuel injection pump or the distributor and the camshaft.

Finally, it may be stated that the vertical arrangement of the impeller gears 5, 6 permits an especially narrow configuration of the crankcase 1.

The present invention is, of course, in no way restricted to the specific disclosure of the specification and drawings, but also encompasses any modifications within the scope of the appended claims.

What we claim is:

1. A lubricant pump arrangement for supplying pressurized lubricant to an internal combustion engine having a cast crank case and a set of timing gears in a timing gear case, the lubricant pump arrangement comprising in combination with the internal combustion engine:

a rough case recess cast in the cast crank case of the engine and left unmachined, the recess being defined by a side wall, a rear wall and an open side, and the recess having an inlet opening through the side wall and an outlet opening extending normally through the rear wall;

a pump housing, smaller than the rough case recess, and forming a space therebetween when seated therein; the pump housing having an open front and a closed back, the closed back having an outlet opening extending normally therethrough and journal means therein; the pump housing further having a surrounding side wall with an inlet opening through the bottom thereof;

two impeller gears having gear shafts with one end journalled in the journal means of the closed back of the pump housing and contained within the pump housing, one of the impeller gears having a drive shaft thereon extending beyond the open side of the rough case and the open front of the pump housing;

a driving gear meshed with the set of timing gears and connected to the drive shaft for rotating the drive shaft and driving the impeller gears;

a closure closing the open side of the recess and open front of the pump housing and being disposed between the driving gear and pump housing, the closure being one wall of the timing gear case and having journals therein for journaling the other ends of the gear shafts;

a rigid tube connecting the outlet opening through the rear wall of the recess to the outlet opening of the pump housing, the rigid tube being smaller than either opening and having flexible sealing gaskets at both ends thereof for effecting seals between the opening through the rear wall of the recess and the opening through the closed back of the pump housing; whereby the pump housing is movable with respect to the crank case recess during assembly thereof so as to ease the assembly process while lessening the volume consumed by the engine while helping to minimize the expense of engine manufacture.

* * * * *